US006896008B2

(12) United States Patent
Lamprillo

(10) Patent No.: US 6,896,008 B2
(45) Date of Patent: May 24, 2005

(54) WEFT THREAD MONITORING DEVICE

(75) Inventor: Stefano Lamprillo, Biella (IT)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/399,381

(22) PCT Filed: Oct. 23, 2001

(86) PCT No.: PCT/EP01/12249

§ 371 (c)(1),
(2), (4) Date: Aug. 11, 2003

(87) PCT Pub. No.: WO02/34983

PCT Pub. Date: May 2, 2002

(65) Prior Publication Data

US 2004/0016472 A1 Jan. 29, 2004

(30) Foreign Application Priority Data

Oct. 24, 2000 (DE) ..... 100 52 703

(51) Int. Cl.[7] ..... D03D 45/54
(52) U.S. Cl. ..... 139/273
(58) Field of Search ..... 139/437, 438, 139/439, 429, 273, 203, 212; 700/140, 130

(56) References Cited

U.S. PATENT DOCUMENTS 4,359,068 A * 11/1982 Loepfe et al. ..... 139/370.2
4,924,917 A 5/1990 Shaw
5,031,669 A 7/1991 Wahhoud et al.
6,470,713 B1 10/2002 Lamprillo

FOREIGN PATENT DOCUMENTS

| | | |
|---|---|---|
| EP | 0333302 A | 9/1989 |
| EP | 0 374 398 A1 | 6/1990 |
| WO | WO 97/40218 | 10/1997 |
| WO | WO 00/52243 | 9/2000 |
| WO | WO 02/34983 | 5/2002 |

* cited by examiner

*Primary Examiner*—John J. Calvert
*Assistant Examiner*—Brian Kauffman
(74) *Attorney, Agent, or Firm*—Flynn, Thiel, Boutell & Tanis, P.C.

(57) ABSTRACT

In a monitoring device used for the weft thread of a weaving machine, which comprises at least one insertion element having a thread clip movable to a thread-release position, and comprising a weft thread detector, which is used for monitoring the movement of the weft thread and which, during each insertion, is activated only for an observation interval ending at least approximately with the release of the inserted weft thread by the thread clip, an electric sensor (S) is provided in an opening device (B) arranged in the weaving machine and used for opening the thread clip (G) of the insertion element, said sensor (S) responding to the release position of the thread clip with a signal (i) representative of the end of the observation interval.

8 Claims, 1 Drawing Sheet

WEFT THREAD MONITORING DEVICE

FIELD OF THE INVENTION

The present invention relates to a monitoring device.

BACKGROUND OF THE INVENTION

In the monitoring device known from WO 00/52243 the observation interval is adjusted at the microprocessor of the control unit of the weft thread detector. Since the point along the thread path at which the weft thread is released can be adjusted by the weaver in dependence upon certain factors, such as the kind of cloth, the cloth width, or the like, also the observation interval must be readjusted accordingly so as to maintain the precision of monitoring. This is complicated.

In weaving machines so-called arrival sensors are frequently used, cf. e.g. EP 0 374 398 A, which output a signal when the weft thread arrives at the cloth edge. These arrival sensors are mostly opto-electronic sensors whose sensitivity must be adjusted to the thread quality in each individual case, whose function is impaired by unavoidable lint, and, when the weaving machine is changed over, it may become necessary to re-position these sensors. Also this procedure is complicated.

It is the object of the present invention to provide a monitoring device of the type mentioned at the beginning, in which the observation interval will be terminated precisely in a structurally simple manner and independently of the thread quality and of possible adjustments of the release time at the weaving machine, e.g. for simplifying the sensitivity adjustment of a self-adaptive weft thread detector.

Surprisingly enough, the aim of terminating the observation interval precisely and exactly at the right point of the thread path can be achieved by a knack, viz. that the weft thread is not scanned directly but that an electronic sensor is used for monitoring the arrival of the thread clip at the release position. The thread quality is of no importance in this connection. Changeovers in the weaving machine, which alter the moment of release along the thread path, do not influence the precision. It goes without saying that the sensor will not inevitably respond to the release position reached by the thread clip, but, if necessary, it will already respond to the movement of the thread clip to the release position. In a weft thread detector with automatic adjustment of the sensitivity to the respective optimum over a plurality of successive insertions, sensitivity adaptation will be facilitated by this sensor which controls the end of the observation interval and which responds to the arrival of the thread clip at the release position. When the sensor indicates that the thread clip has reached the release position, it operates with a consciously accepted uncertainty factor, since its signal does not represent reliably whether or not the weft thread has arrived at this point. This is, however, irrelevant, since the adequate movement of the weft thread up to the end of the observation interval is monitored by the weft thread detector itself in any case. Any sensor, e.g. an opto-electronic sensor, an approximation sensor, a piezo-electric sensor or the like, which is capable of detecting the moment at which the thread clip reaches its release position, is suitable to be used as an electronic sensor.

Since in rapier weaving machines or projectile weaving machines the thread clip is predominantly moved to the release position by a collision impact, and since substantial kinetic energy is exchanged at the moment of this collision impact, a piezo sensor which is acted upon by this energy shock and which outputs the signal in response to a transmission of said collision impact will be particularly suitable for use as a sensor.

A high operational reliability and an expressive signal are obtained when the sensor is arranged directly on the stop element in the opening device, the opening device and/or the stop element being adjustable relative to the path of movement of the insertion element. This position of the sensor guarantees that the sensor will directly scan the collision impact when the thread clip reaches the release position and that, if changeovers are necessary in the weaving machine in the area of the opening device, it will take part in these changeovers so that readjustments will not be necessary at this sensor, neither in the case of changes in the thread quality nor in the case of such changeovers.

The sensor can comprise a fork-shaped body with at least one piezo-ceramic element in the area of a fork prong, said body being, if desired, attached to the stop element or inserted therein and secured in position.

If an opening device having a control plate as a stop element is used, the sensor should be secured in position on or in said control plate.

If the sensor in question is a piezo sensor, which responds to the collision impact, it will be expedient to arrange the sensor in the vicinity of the opening surface of the plate at a point where the collision impact is discernible clearly and in an unadulterated form.

The sensor could be completed by providing in the body or in the signal transmission path an amplifying component for signal conditioning. The signal outputted and conditioned by the sensor can be directly used for terminating the observation interval in this way.

Finally, it may be expedient when, in the case of comparatively small cloth widths, the sensor is connected via a cable to the weft thread detector, or to the control of said weft thread detector, or to the control of the weaving machine. In the case of comparatively large cloth widths, it is imaginable to choose a wireless signal transmission because the distance can then be comparatively large.

BRIEF DESCRIPTION OF THE DRAWINGS

Embodiments of the subject matter of the invention are explained making reference to the drawing, in which.

DETAILED DESCRIPTION

Figure 1:
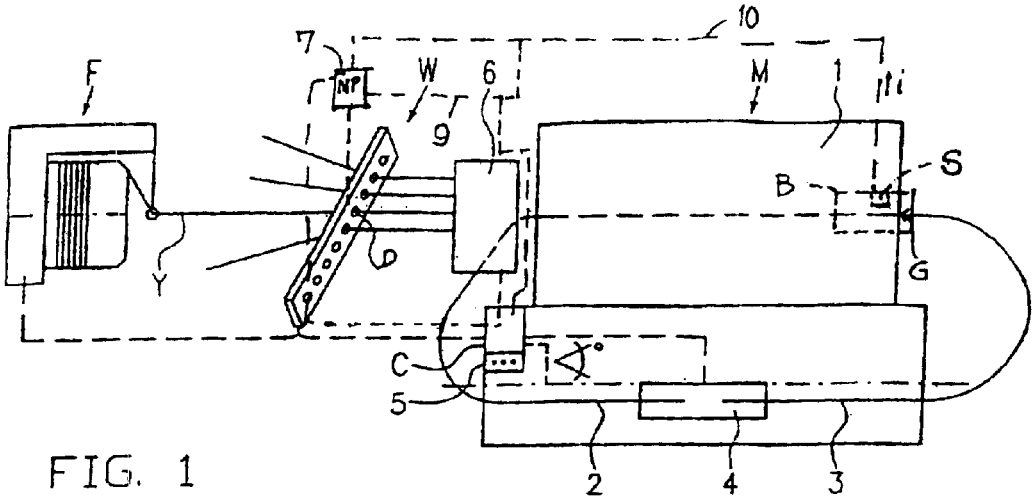
FIG. 1 shows schematically a thread processing system including a weft thread detector arrangement.

A thread processing system in FIG. 1 includes a weaving machine M, in the present case a rapier weaving machine, at least one thread feeding device F, and a weft thread detector device W in which e.g. a plurality of parallel weft thread detectors D are combined, each weft thread detector D being used for one weft thread Y. The rapier weaving machine M includes a shed 1 as well as a bringer rapier 2 and a receiver rapier 3, which are driven by a drive mechanism 4. Furthermore, the weaving machine has provided therein a main control and monitoring unit C at a weaving machine control panel 5. In front of the insertion side of the shed 1, a thread selecting device 6 is provided, which is controlled e.g. by the control unit C. The weft thread detector device W is connected e.g. to the control unit C and/or to the control of the weft thread feeding device or to a so-called stop-motion relay (not shown) for deactivating the weaving machine.

Instead of the rapier weaving machine M comprising bringer and receiver rapiers 2, 3, it would also be possible to use a rapier weaving machine comprising a single rapier, or a projectile weaving machine. A feature which is common to these types of weaving machines is that they have at least one insertion element having a thread clip G which, by means of an opening device B arranged at the shed end, is adapted to be moved to a thread release position and releases the weft thread at this point so that the speed of this weft thread is decelerated to zero.

Each of the weft thread detectors D can be implemented as a thread guiding element for a weft thread Y and comprise a piezo-electric sensor, which is not shown. The weft thread Y passes through the weft thread detector D and excites the piezo-electric sensor thereof by friction forces or vibrations to which the sensor responds by generating an electric run signal. As has been explained in detail in WO00/52243, which is herewith incorporated by reference, the run signal is converted into a run output signal as long as the weft thread keeps on running. If the weft thread Y becomes slack or breaks or if it comes to a halt, no run signal will be outputted. For controlling the weft thread detector D with respect to its automatic sensitivity adjustment, among other parameters, during a plurality of insertion cycles, a microprocessor MP can be provided, which is connected e.g. to a stop switch for the weaving machine. At an input section 7, it is possible to adjust e.g. the angle of rotation of the main shaft of the weaving machine at which the so-called SYNC signal for initiating an insertion is outputted and transmitted to the control of the weft thread feeding device. The weft thread detector D does not monitor the weft thread movement over 360° of the rotation of the main shaft of the weaving machine, but only over a certain observation interval, e.g. between 220° and 310° of a full 360° rotation. The end of the observation interval should correspond to the rotary angle position at which also the control unit C of the weaving machine stops taking into account the output signal of the weft thread detector D for producing a stop signal for the weaving machine in response to an error signal on the part of the weft thread detector D. The observation interval should end as soon as the receiver rapier 3 in the rapier weaving machine M releases the weft thread Y, since a critical phase of weft thread monitoring is, in most cases, the end phase of an insertion.

According to the present invention, the opening device B, which is normally arranged in the area of the end of shed 1 and which is used for the thread clip G of the insertion element that is just finishing the insertion, e.g. the receiver rapier 3, is equipped with a sensor S responding with a signal i to the arrival at the release position or the movement of the thread clip G to said release position, said signal i being transmitted over a transmission path 10 e.g. to the microprocessor MP or to the control C, which may be connected to the microprocessor MP via a transmission path 9. The signal i stops the observation interval of the weft thread detector D. It can also be used as information for the control unit C of the weaving machine M so as to confirm, in cooperation with the run signal of the weft thread detector, that an adequate insertion has taken place. Since, independently of the thread quality, the sensor S only responds to the arrival of the thread clip G at the release position, a readjustment will not be necessary when the weaving machine is changed over to another thread quality. In a rapier weaving machine or in a projectile weaving machine, the opening device B causes the thread clip G to move to the release position by a collision impact of two stop elements. An opening device is shown, by way of example, in WO97/40218 which is herewith referred to.

Figure 2:
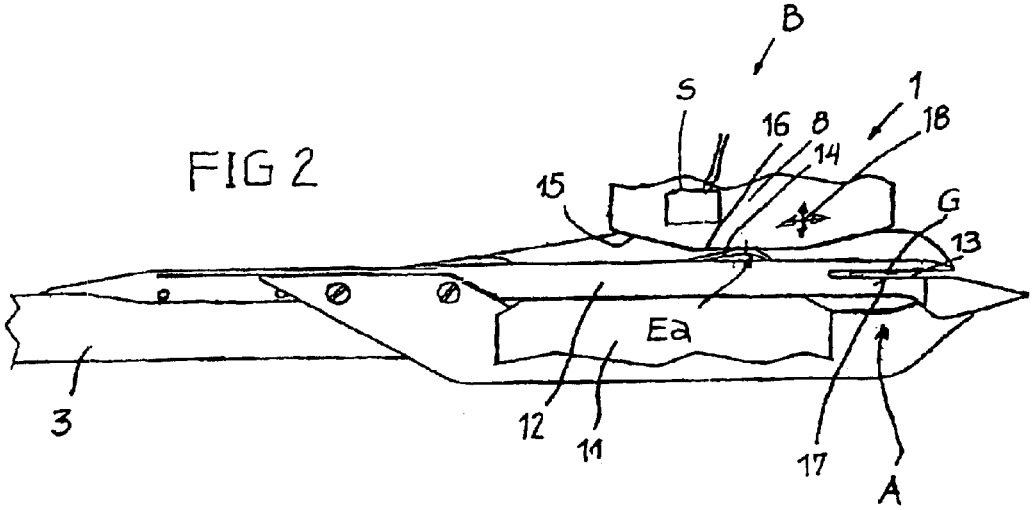
FIG. 2 shows an opening device for a thread clip of an insertion element in the system of FIG. 1.

FIG. 2 clearly shows, in a side view, an opening device B of the type suitable for use in the weaving machine M according to FIG. 1. The receiver rapier 3 carries a weft thread transport element A with a guide body 12. The thread clip G, which cooperates with a clamping surface 17, engages a reception slot 13, said thread clip G being operatively connected to a stop element E2, which is here implemented as a leaf spring 14, in such a way that, when the stop element E2 is pressed down, the thread clip G will be removed from said clamping surface 17 in a downward direction and release the weft thread which had been secured in position on said clamping surface 17 up to this moment.

In said opening device B, a stationary plate 11 for the guide body 12 is provided so as to temporarily position the transport element. A control plate 8, which represents a further stop element E1 of the opening device B, is in alignment with the stop element E2, said stop element E1 being adjustable in the directions of the arrows 18 so as to be able to adapt the release of the weft thread to the desired operating conditions in the shed. In the embodiment shown, the control plate 8 (the adjustable stop element E1) has a front, oblique opening surface 15 and a lower horizontal opening surface 16, which are intended to be used for cooperating with the leaf spring 14 (stop element E2 on the transport element A). The control plate 16 has the sensor S attached thereto, which responds to the arrival of the thread clip G at the release position and outputs its signal i at this moment.

Since, due to the high speed of the insertion element, the mutual contact between the stop elements E1, E2 produces a marked collision impact, which opens the thread clip G, it will be expedient to equip the sensor S with a piezo element, which registers the collision impact and generates a signal i on the basis thereof. The sensor S, which is arranged on the control plate 16, takes part in any kind of adjustments of the control plate 16 in the directions of the arrows 18, which may be carried out e.g. by the weaver, so that it will always respond exactly at the moment at which the thread clip G is forced to move to the release position by the collision impact, whereupon the weft thread Y is released, and the speed of said weft thread drops to zero.

Figure 3:
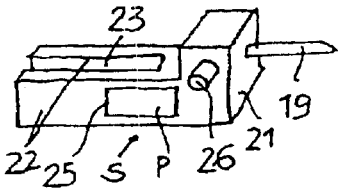
FIG. 3 shows a perspective view of a sensor.

In FIG. 3 one possible embodiment of the sensor S is outlined. This sensor S comprises a body 21 having an L-shaped cross-section and consisting e.g. of a metal, said body 21 including two fork prongs 22 defining a gap 23 between them. A piezo-ceramic element P, 25 is incorporated at least in the area of one fork prong 22. An adjustment of the sensor can be carried out at an element 26; the sensor can be connected to the respective signal receiver via a line 19.

Figure 4:
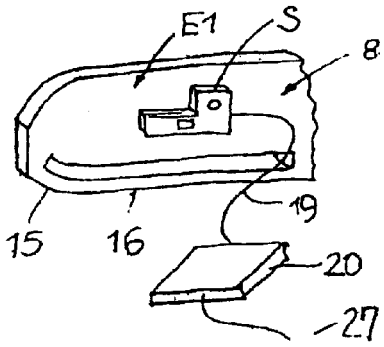
FIG. 4 shows a perspective view of a control plate having a sensor attached thereto.

According to FIG. 4, the sensor S is connected to a terminal connector 27 via a line 19 and an amplifier 20, which is also used for signal conditioning. The amplifier 20 may also be incorporated in the body 21 or provided at the receiver. The sensor S could be attached and secured to the control plate 8 (FIG. 4) with its fork prongs 22 and the gap 23, or it is, as shown in FIG. 4, secured to the side of the control plate 8. It would also be imaginable to provide an opening in said control plate and to place at least the piezo-ceramic element P, 25 therein.

When the collision impact takes place, the piezo-ceramic element 25 is excited by the impact energy between the stop elements E1 and E2 and caused to output the signal i by means of which the observation interval of the weft thread detector D is terminated.

According to a preferred embodiment of the present invention, a piezo knock sensor, resembling e.g. a tuning fork with a piezo element, is positioned in the opening device at a suitable location of the weaving machine, said piezo knock sensor responding to the marked knock, which occurs when the thread clip of the insertion element is being opened, and terminating the observation interval of the weft thread detector, which has monitored the weft thread with respect to an adequate movement within a certain phase of a 360° rotational movement of the main shaft of the weaving machine and which transmits its monitoring result to the control device of the weaving machine. The response of the piezo knock sensor to the knock occurring when the thread clip is being opened will suffice to terminate the observation interval precisely and independently of the respective thread quality and of possible shifts of the thread clip-opening point in the thread path. Although the signal of the piezo knock sensor is not able to provide any information making known whether or not an adequate insertion of the weft thread has taken place, because said sgnal is only representative of the release position of the thread clip, this circumstance is irrelevant as far as the monitoring function of the weft thread detector is concerned. If weft thread breakage or some other disturbance in view of which insertion cannot be finished should already have occurred in an earlier phase of the insertion, the weaving machine will be switched off anyhow, before the piezo knock sensor would have to respond.

What is claimed is:

1. A monitoring device for the weft thread of a weaving machine, in particular a rapier weaving machine or a projectile weaving machine, comprising:

at least one mechanical insertion element having a thread clip that is movable to a release position;

at least one weft thread detector for monitoring the movement of the weft thread during insertion through a weaving shed having an insertion end side and an arrival end side, said weft thread detector being, during each insertion, activated for a limited observation interval ending at least approximately with the release of the inserted weft thread by the thread clip; and an electronic sensor provided in an opening device arranged at the arrival shed end side for opening the thread clip of the insertion element by moving the thread clip into said release position, said thread clip being adapted to be moved to the release position by a collision impact between co-acting stop elements which are arranged on the insertion element and in the opening device, respectively, said electronic sensor responding either to the movement of the thread clip to the release position or to the arrival of the thread clip at the release position with a signal representing the end of the observation interval of the weft thread detector.

2. The monitoring device according to claim 1, wherein said electronic sensor is a piezo sensor provided with a piezo-ceramic element, which responds to the collision impact.

3. The monitoring device according to claim 1, wherein said electronic sensor is arranged directly on the stop element of the opening device, and wherein the opening device and/or the stop element of said opening device is adjustable relative to the path of movement of the insertion element through the weaving shed.

4. The monitoring device according to claim 2, wherein the electronic sensor comprises a body designed like a tuning fork with fork prongs, with said at least one piezo-ceramic element being provided on one of said fork prongs.

5. The monitoring device according to claim 3, wherein said stop element of said opening device is a control plate, wherein said electronic sensor is secured in position on or in said control plate.

6. The monitoring device according to claim 5, wherein said control plate comprises at least one thread clip opening surface, and said electronic sensor is positioned in the vicinity of said opening surface.

7. The monitoring device according to claim 4, wherein a signal conditioning amplifier is provided either in the body of said electronic sensor and/or in a signal transmission path for said signal.

8. The monitoring device according to claim 1, wherein said electronic sensor is connected either to the weft thread detector to the control of said weft thread detector, or to the control of the weaving machine, respectively, via a line or a wireless connection.

* * * * *